US011884452B2

(12) United States Patent
Shen et al.

(10) Patent No.: US 11,884,452 B2
(45) Date of Patent: Jan. 30, 2024

(54) CHILD-RESISTANT CLOSURE SYSTEM

(71) Applicant: Yuan Ding International (Shanghai) Co., Ltd., Shanghai (CN)

(72) Inventors: Haowei Shen, Shanghai (CN); Zhengqiang Xie, Shanghai (CN)

(73) Assignee: Yuan Ding International (Shanghai) Co., Ltd., Shanghai (CN)

( * ) Notice: Subject to any disclaimer, the term of this patent is extended or adjusted under 35 U.S.C. 154(b) by 136 days.

(21) Appl. No.: 17/074,389

(22) Filed: Oct. 19, 2020

(65) Prior Publication Data

US 2021/0114776 A1 Apr. 22, 2021

Related U.S. Application Data

(60) Provisional application No. 62/923,143, filed on Oct. 18, 2019.

(51) Int. Cl.
*B65D 33/25* (2006.01)
*B65D 50/04* (2006.01)

(52) U.S. Cl.
CPC ..... *B65D 33/25* (2013.01); *B65D 50/04* (2013.01)

(58) Field of Classification Search
CPC ..... B65D 33/25; B65D 50/04
USPC ..... 206/1.5
See application file for complete search history.

(56) References Cited

U.S. PATENT DOCUMENTS 4,878,763 A * 11/1989 Ausnit ..... B65D 33/2508 24/585.12
4,905,298 A 2/1990 Walor
5,235,731 A 8/1993 Anzai
5,398,387 A 3/1995 Torigoe
5,931,582 A 8/1999 Nichols
(Continued)

FOREIGN PATENT DOCUMENTS

CN 2431229 5/2001
CN 108577109 9/2018
(Continued)

OTHER PUBLICATIONS

Machine translation of FR-3034760-A1.*
(Continued)

*Primary Examiner* — Jes F Pascua

(74) *Attorney, Agent, or Firm* — Sheppard, Mullin, Richter & Hampton LLP

(57) ABSTRACT

A child-resistant resealable container comprising a closure strip assembly having first and second lateral interlocking members. The first lateral interlocking member is attached to a first extension strip, and the second lateral interlocking member is attached to a second extension strip. The first and second extension strips are attached to the interior surfaces of the respective first and second walls below the top edge of the first and second walls such that a portion of the first and second walls extends to define first and second flaps. The first and second lateral interlocking members are configured to become disengaged from each other when the first and second flaps are pulled apart from each other as the second extension strip is held against the interior surface of the second wall, but remain connected when the flaps are pulled apart without also holding the second extension strip against the interior surface of the second wall.

17 Claims, 8 Drawing Sheets

(56) References Cited

U.S. PATENT DOCUMENTS

| | | | | |
|---|---|---|---|---|
| 6,231,236 | B1 | 5/2001 | Tilman | |
| 6,367,128 | B1 | 4/2002 | Galkiewicz | |
| 6,546,604 | B2 | 4/2003 | Galkiewicz | |
| 7,506,487 | B2 | 3/2009 | Eads et al. | |
| 7,674,039 | B2 | 3/2010 | McMahon | |
| 9,015,910 | B2 | 4/2015 | Septien Rojas | |
| 10,011,403 | B1 | 7/2018 | Kirsh | |
| 10,427,839 | B2 | 10/2019 | Johnston | |
| 11,292,638 | B2 | 4/2022 | Hansen | |
| 2012/0045151 | A1 | 2/2012 | Eouzan | |
| 2014/0161374 | A1* | 6/2014 | Septien Rojas | B65D 33/2541 383/63 |
| 2015/0336713 | A1 | 11/2015 | Gum | |
| 2017/0190476 | A1 | 7/2017 | Goto | |
| 2018/0127155 | A1* | 5/2018 | Johnston | B65D 33/20 |
| 2018/0312301 | A1 | 11/2018 | Martial | |
| 2018/0312302 | A1 | 11/2018 | Septien Rojas et al. | |
| 2018/0319546 | A1 | 11/2018 | Liu | |
| 2019/0315524 | A1* | 10/2019 | Huang | B65D 33/2508 |

FOREIGN PATENT DOCUMENTS

| | | | | |
|---|---|---|---|---|
| CN | 109071070 | | 12/2018 | |
| DE | 102015121540 | | 6/2017 | |
| EP | 3693288 | | 8/2020 | |
| FR | 3034760 | A1 * | 10/2016 | B65D 33/2508 |
| WO | WO2014066025 | | 5/2014 | |
| WO | WO-2016114304 | A1 * | 7/2016 | A44B 19/16 |
| WO | WO2019028216 | | 2/2019 | |
| WO | WO-2019172558 | A1 * | 9/2019 | B65B 61/188 |

OTHER PUBLICATIONS

Child Resistant Bag, https://www.impakcorporation.com/flexible_packaging/child-resistant-pouch/cr-slider/ZPCR08506W, Aug. 16, 2021.

Bag with a Childproof Locking System, http://www.leaderflexible.com/product-detail/child-resistant-bag-child-proof-bag-marijuana-bag/, Aug. 16, 2021.

Child-Resistant Locking Pouches, https://www.clearbags.com/bags/child-resistant, Aug. 16, 2021.

Child Resistant Bags, https://stinksack.com/product-category/child-resistant/, Aug. 16, 2021.

Child Resistant Exit Bags, https://420stock.com/product/12x9-child-resistant-exit-bags/, Aug. 16, 2021.

Pinch n Slide, http://www.pinchnslide.com/, Aug. 16, 2021.

Child-Resistant Thumb-Pocket Zipper Bag, https://www.impakcorporation.com/flexible_packaging/child-resistant-pouch/thumb-pocket/ZCR0550675TE, Aug. 16, 2021.

* cited by examiner

CHILD-RESISTANT CLOSURE SYSTEM

CROSS-REFERENCE TO RELATED APPLICATIONS

This application claims priority to U.S. Provisional Patent Application No. 62/923,143, filed Oct. 18, 2019, which is hereby incorporated by reference in its entirety as if fully set forth herein.

FIELD OF THE INVENTION

The disclosed technology relates generally to resealable containers and, more particularly, to resealable containers having a child-proof or child-resistant closure mechanism.

BACKGROUND

Flexible packaging bags with resealable zipper closures are widely available for holding a variety of products. Zipper closures on conventional bags can be easily opened and are not appropriate for use with medicines and other potentially hazardous substances. Existing child-proof zipper systems are overly complicated and can be difficult and expensive to manufacture. It should be appreciated that there is a need for an improved child-resistant closure system. The present invention fulfills this need and provides further related advantages.

BRIEF SUMMARY OF THE INVENTION

The present invention is embodied in a resealable container comprising a first wall, a second wall, a first extension strip, a second extension strip, and a closure strip assembly. In one embodiment, the first and second walls can be sealed together along respective side edges and bottom edges of the first and second walls such that interior surfaces of the first and second walls form a storage space therebetween. In another embodiment, a top edge of the first wall and a top edge of the second wall can define an opening for the storage space.

In one embodiment, the first extension strip can have a first edge and a second edge. In another embodiment, the first edge of the first extension strip can be attached to the interior surface of the first wall below the top edge of the first wall such that a portion of the first wall extends from the first edge of the first extension strip to the top edge of the first wall to define a first flap. In a further embodiment the second edge of the first extension strip can be positioned between the first edge of the first extension strip and the top edge of the first wall.

In one embodiment, the second extension strip can have a first edge and a second edge. In another embodiment, the first edge of the second extension strip can be attached to the interior surface of the second wall below the top edge of the second wall. In a further embodiment, the second edge of the second extension strip can be positioned opposite the first edge of the second extension strip, between the first edge of the second extension strip and the bottom edge of the second wall. In an additional embodiment, a portion of the second wall can extend adjacent the second edge of the second extension strip to the top edge of the second wall to define a second flap.

In one embodiment, the closure strip assembly can comprise a first lateral interlocking member and a second lateral interlocking member. In another embodiment, the first lateral interlocking member can be operatively connectable to the second lateral interlocking member.

In one embodiment, the first and second lateral interlocking members can be configured to remain operatively connected when the first flap and the second flap are pulled apart without holding the second extension strip against the interior surface of the second wall. When the first flap and the second flap are pulled apart without holding the second extension strip against the interior surface of the second wall, a relative rotation between the first and second lateral interlocking members can be minimized.

In one embodiment, the first and second lateral interlocking members can be configured to become disengaged from each other when the first flap and the second flap are pulled apart from each other as the second extension strip is held against the interior surface of the second wall. In another embodiment, the second extension strip is held against the interior surface of the second wall at a location close to the second lateral interlocking member to effectuate the rotational movement of the second lateral interlocking member. In a further embodiment, the first and second lateral interlocking members can be configured to become disengaged from each other when the first flap and the second flap are pulled apart from each other as the first extension strip is additionally held against the interior surface of the first wall. When the first flap and the second flap are pulled apart from each other as first extension strip is additionally held against the interior surface of the first wall and the second extension strip is held against the interior surface of the second wall, the relative rotation between the first and second lateral interlocking members can be maximized. In yet further embodiment, the first extension strip can be held against the interior surface of the first wall at a location close to the first lateral interlocking member to effectuate the rotational movement of the first lateral interlocking member.

In one embodiment, the first lateral interlocking member can be attached to first extension strip between the first and second edges of the first extension strip, and the second lateral interlocking member can be attached to the second edge of the second extension strip.

In one embodiment, the first lateral interlocking member can comprise at least two asymmetrical female strips. In another embodiment, the second lateral interlocking member can comprise at least two asymmetrical male strips. In a further embodiment, the first lateral interlocking member can comprise at least two female interlocking channels. In an additional embodiment, the second lateral interlocking member can comprise at least two male interlocking beads.

In one embodiment, each of the at least two asymmetrical female channels can comprise a first J-shaped member. In another embodiment, each of the at least two asymmetrical male beads can comprise a second J-shaped member. In a further embodiment, the first J-shaped member can face the bottom edge of the first wall. In an additional embodiment, the second J-shaped member can face the top edge of the second wall.

In one embodiment, the first J-shaped member can engage the second J-shaped member when the first lateral interlocking member is operatively connected to the second lateral interlocking member. In another embodiment, the first and second lateral interlocking members can be operable to disengage each other when the female interlocking strip is rotated relative to the male interlocking strip so that the first J-shaped member disengages from the second J-shaped member. In a further embodiment, the first and second lateral interlocking members can be operable to disengage each other when the female interlocking strip is rotated relative to the male interlocking strip so that a free end of the first J-shaped member rotates toward the top edge of the first wall and a free end of the second J-shaped member rotates toward the bottom edge of the second wall.

In one embodiment, each of the first wall and the second wall can be a unitary sheet.

In one embodiment, the second edge of the second extension strip is not attached to the interior surface of the second wall.

In one embodiment, the first lateral interlocking member can comprise a lower attached-portion and an upper free-portion opposite the lower attached-portion. In another embodiment, the lower attached-portion can be coupled to first extension strip between the first and second edges of the first extension strip. In a further embodiment, the upper free-portion is not attached to first extension strip. In an additional embodiment, the upper free-portion is not coupled to the interior surface of the first wall.

In one embodiment, the second lateral interlocking member can comprise an upper attached-portion and a lower free-portion opposite the upper attached-portion. In another embodiment, the upper attached-portion can be attached to the second edge of the second extension strip. In a further embodiment, the lower free-portion is not attached to the second extension strip. In an additional embodiment, the lower free-portion is not coupled to the interior surface of the second wall.

In one embodiment, the second extension strip can be between the second lateral interlocking member and the top edge of the second wall.

Each feature or concept outlined above is independent, and can be combined with the other features or concepts outlined above or with any other feature or concept disclosed in this application. Other features and advantages of the invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
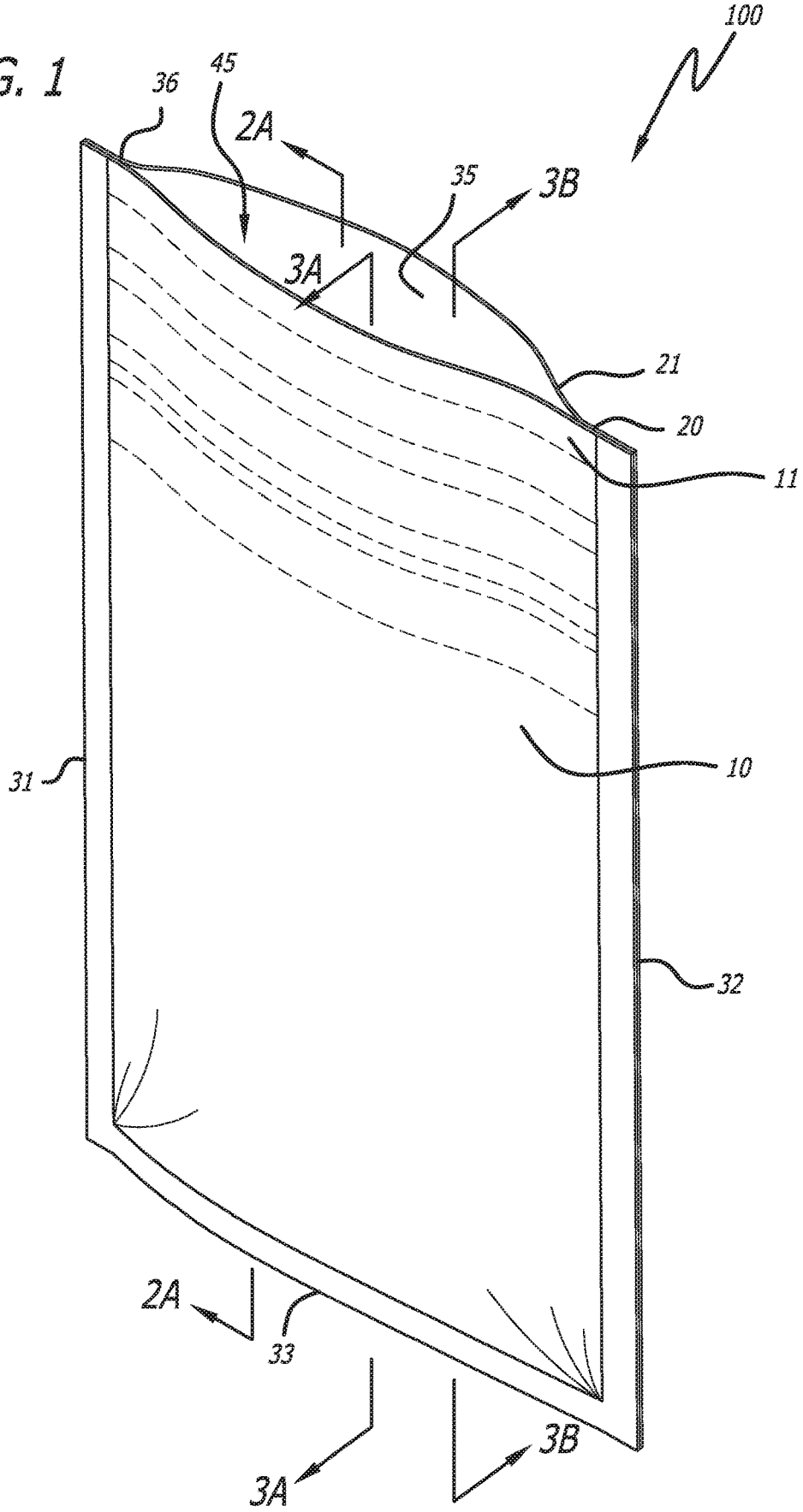
FIG. 1 is a perspective view of a resealable container in accordance with one embodiment.

Flexible packaging bags with resealable zipper closures are widely available for holding a variety of products. Zipper closures on conventional bags can be easily opened and are not appropriate for use with medicines and other potentially hazardous substances. Existing child-proof zipper systems are overly complicated and can be difficult and expensive to manufacture. It should be appreciated that there is a need for an improved child-resistant closure system. The present invention fulfills this need and provides further related advantages.

The present technology relates to a resealable container that is child-proof or child-resistant. In other words, the resealable container does not allow a person without knowledge of how to properly open the resealable container to open the resealable container and get access to content within the resealable container. The resealable container can employ a female and male interlocking members that must be properly rotated to cause the interlocking members to disengage (e.g., decouple). When a person without knowledge on how to properly open the resealable container attempts to open the resealable container in a sealed configuration, the interlocking members do not properly rotate to cause disengagement of the interlocking members. Alternatively, when a person with knowledge attempts to open the resealable container, the interlocking members can be properly rotated to cause the disengagement.

With reference to FIGS. 1-6 of the illustrative drawings, there is shown a resealable container 100 having a child-resistant closure system according to one embodiment. The resealable container 100 can include a first wall 10 and a second wall 20 opposing each other. The first and second walls 10, 20 can be sealed together (e.g., heat-sealed) along respective side edges 31, 32 and a bottom edge 33 of the sealed first and second walls 10, 20 such that interior surfaces 34, 35 of the first and second walls 10, 20 form a storage space 40 therebetween. In one embodiment, each of the first wall 10 and the second wall 20 is made of a unitary sheet. A top edge 36 of the first wall 10 and a top edge 37 of the second wall 20 can define an opening 45 for the storage space 40. The first wall 10 and the second wall 20 can comprise respective interior surfaces 34, 35.

Although the resealable container 100 is shown as a rectangular form, it is understood that the resealable container 100 can have other forms. For example, the resealable container 100 can be triangular form, pentagonal form, hexagonal form, halfmoon-like form, or the like. The container 100 can comprise various materials, including thermoplastic films such as polyethylene. Different parts or portions of the resealable container 100 can be made of flexible, semi-flexible, semi-stiff, or stiff materials.

With particular reference to the perspective view of the resealable container 100 in FIG. 1, the resealable container 100 can provide an opening along an axis 2A. The inner surfaces 34, 35 of the respective first wall 10 and second wall 20 can be pulled along directions 3A and 3B to provide the opening 45.

Figure 2A:
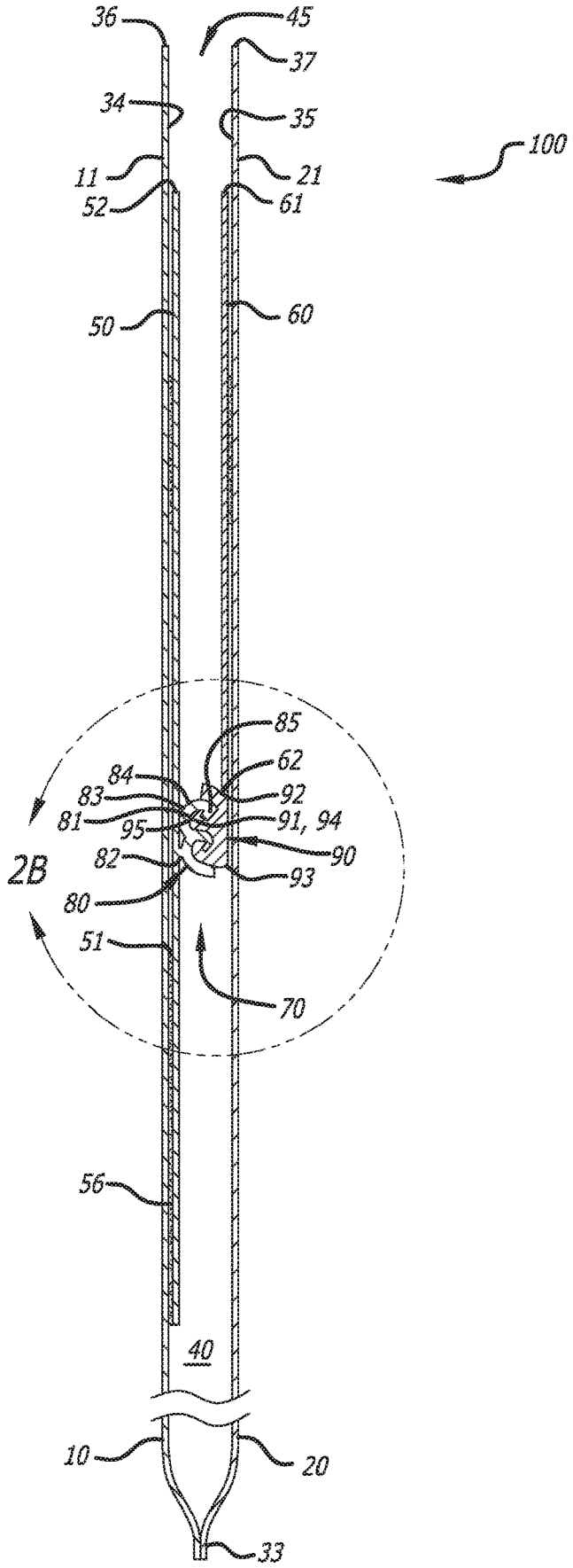
FIG. 2A is a cross-sectional side view of the resealable container of FIG. 1 showing a closure strip assembly in a sealed configuration.
Figure 2B:
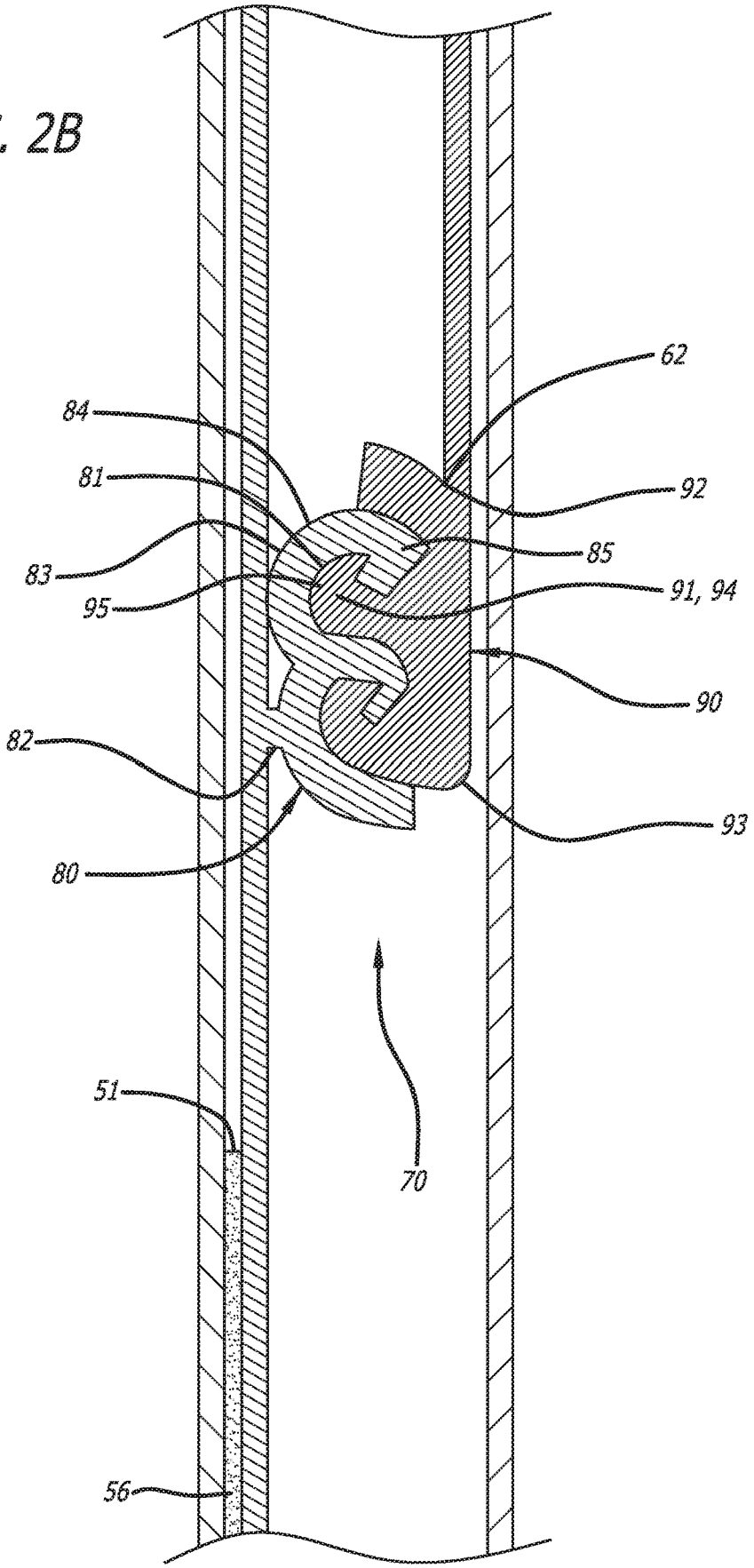
FIG. 2B is a detailed cross-sectional side view of the closure strip assembly from FIG. 2A.
Figure 3A:
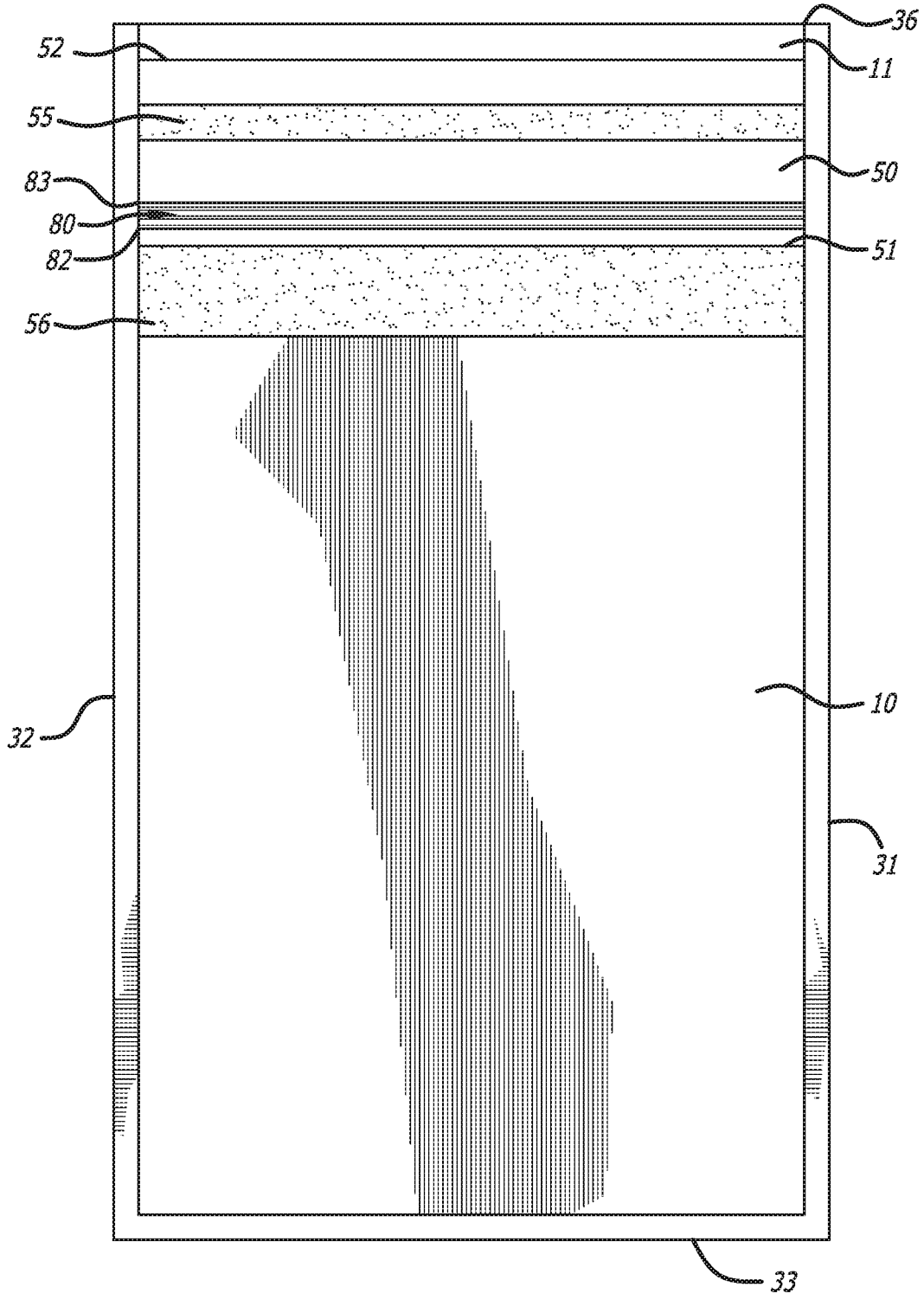
FIG. 3A is a cross-sectional front view of a first wall of the resealable container of FIG. 1.
Figure 3B:
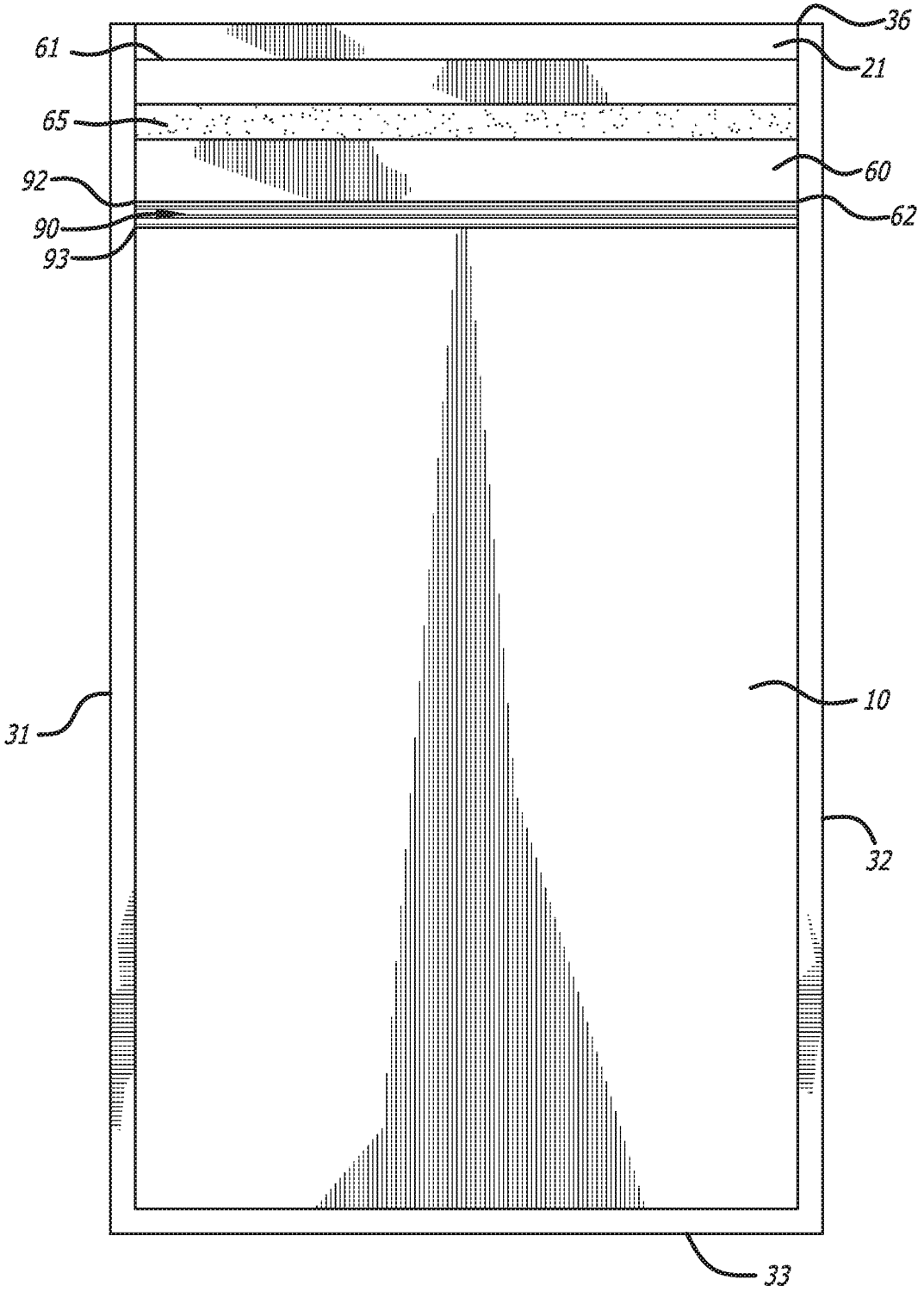
FIG. 3B is a cross-sectional front view of a second wall of the resealable container of FIG. 1.

With particular reference to the cross-sectional side views of the resealable container 100 in FIGS. 2A and 2B, the resealable container 100 can further comprise a closure strip assembly 70. The closure strip assembly 70 can comprise a first lateral interlocking member 80 and a second lateral interlocking member 90. The interlocking members 80, 90 can be laterally positioned along an axis (e.g., the axis 2A of FIG. 1) as illustrated in FIGS. 3A and 3B. The first lateral interlocking member 80 can be mechanically coupled (e.g., engaged) with the second lateral interlocking member 90 to seal the opening 45 of the container 100 in a sealed configuration. Further, the first lateral interlocking member 80 can be mechanically decoupled (e.g., disengaged) from the second lateral interlocking member 90 to provide the resealable container 100 in an opened configuration that allows access into the opening 45. Operations of the interlocking members are further described in relation to FIGS. 5 and 6.

In one embodiment, the first lateral interlocking member 80 can comprise an attached portion 82 and a free portion 83 opposite the attached portion 82. In some embodiments, the attached portion 82 of the first lateral interlocking member 80 can be directly attached to a first extension strip 50, but the free portion 83 of the first lateral interlocking member 80 may not directly attached to the first extension strip 50. As the attached portion 82 is attached to the first extension strip 50 but the free portion 83 is not, when the resealable container 100 is attempted to be opened, by an outward force applied to the first extension strip 50 along axis 3A of FIG. 1, the free portion 83 can be rotated along a trajectory 2B of FIG. 2A. The first extension strip 50 can comprise a first edge 51 and a second edge 52. The first edge 51 and the second edge 52 can be termed "edges" as they can be seen in FIG. 3A along the axis 2A in FIG. 1 of the resealable container 100. The first edge 51 of the first extension strip 50 can be attached to the interior surface 34 of the first wall 10 below the top edge 36 of the first wall 10. The second edge 52 of the first extension strip 50 can be at a location between the first edge 51 of the first extension strip 50 and the top edge 36 of the first wall 10.

Figure 6:
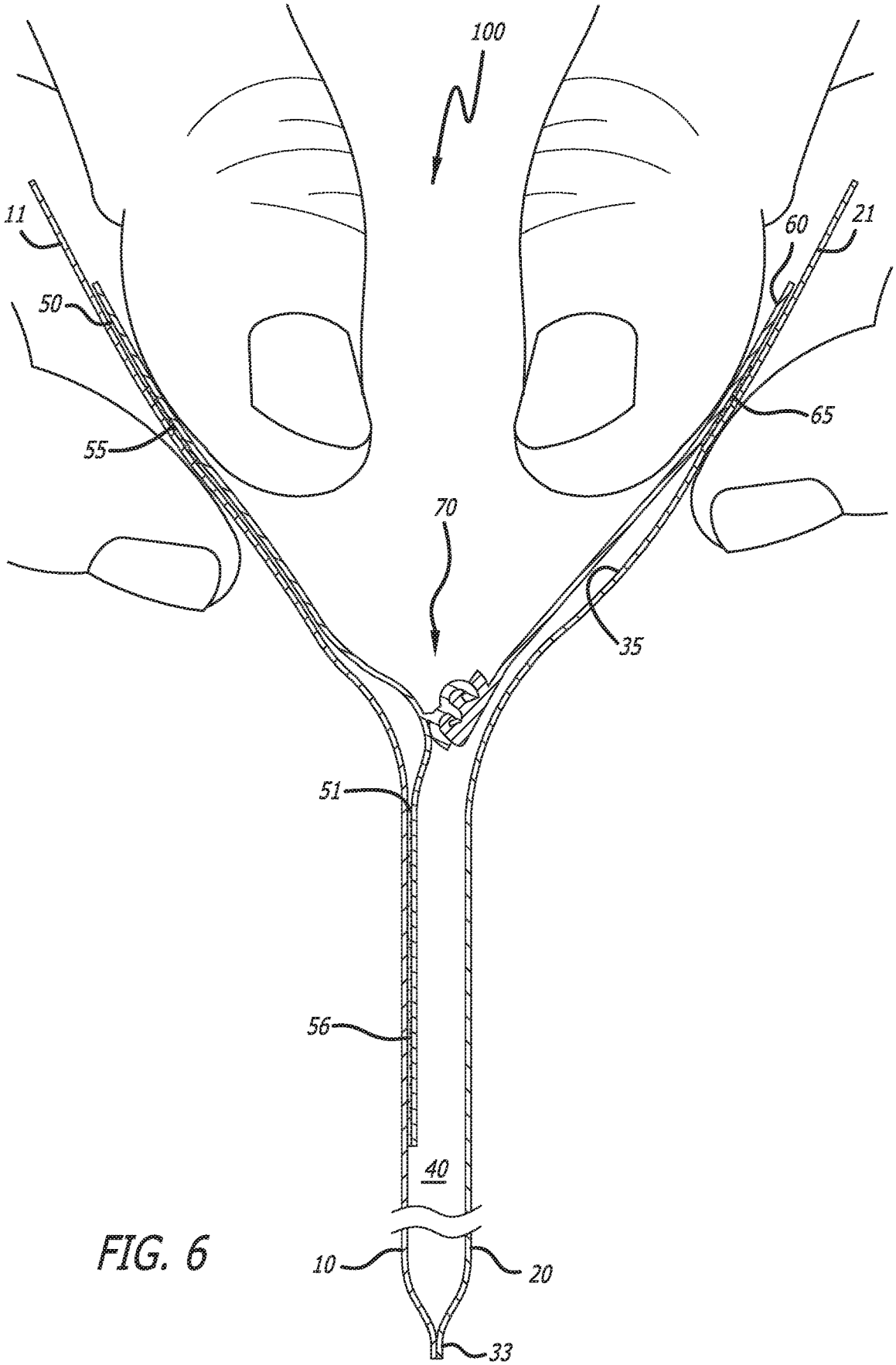
FIG. 6 is a cross-sectional side view of the resealable container of FIG. 1 showing an incorrect opening attempt by a user on the resealable container.

A portion of the first wall 10 that extends above the first edge 51 to the top edge 36 can define a first flap 11 of the first wall 10. At least a portion of the first extension strip 50 between the second edge 52 and the first lateral interlocking member 80 is attached to the inner surface 34 of the first wall 10. In one embodiment, the attached portion 82 of the first lateral interlocking member 80 can be attached to the first extension strip 50 at a location between the first and second edges 51, 52 of the first extension strip 50. FIG. 6 provides additional visual aid of the first extension strip 50, the first flap 11, and the first lateral interlocking member 80 of the closure strip assembly 70.

In one embodiment, the second lateral interlocking member 90 can comprise an attached portion 92 and a free portion 93 opposite the attached portion 92 of the second lateral interlocking member 90. In some embodiments, the attached portion 92 of the second lateral interlocking member 90 can be attached to a second extension strip 60, but the free portion 93 of the second lateral interlocking member 90 is not directly attached to the second extension strip 60. As the attached portion 92 can be directly attached to the second extension strip 60 but the free portion 93 may not be, when the resealable container 100 is attempted to be opened, by an outward force applied to the second extension strip 60 along axis 3B of FIG. 1, the free portion 93 can be rotated along a trajectory 2B of FIG. 2A.

The second extension strip 60 can comprise a first edge 61 and a second edge 62. The first edge 61 and the second edge 62 can be termed "edges" as they can be seen in FIG. 3B along the axis 2A in FIG. 1 of the resealable container 100. The first edge 61 of the second extension strip 60 can define a portion of the interior surface 35 of the second wall 20 and a portion of the second extension strip 60 that are attached to each other above the second lateral interlocking member 90. The second edge 62 of the second extension strip 60 can be at a location opposite the first edge 61 of the second extension strip 60, between the first edge 61 of the second extension strip 60 and the bottom edge 33 of the second wall 20. The second edge 62 of the second extension strip 60 can define a portion of the second extension strip 60 from the first edge 61 of the second extension strip 60 toward the second lateral interlocking member 90.

A portion of the second wall 20 from the top edge 37 to the second edge 62 can define a second flap 21 of the second wall 20. In one embodiment, the attached portion 92 of the second lateral interlocking member 90 can be attached to the second extension strip 60 at a location below the first and second edges 61, 62 of the second extension strip 60. FIG. 6 provides additional visual aid of the second extension strip 60, the second flap 21, and the second lateral interlocking member 90 of the closure strip assembly 70.

With particular reference to the cross-sectional front views of the resealable container 100 in FIGS. 3A and 3B, the first lateral interlocking member 80 can be attached to the first extension strip 50 above the first edge 51 of the first extension strip 50 and below the second edge 52 of the first extension strip 50. In contrast, the second lateral interlocking member 90 can be attached to the second extension strip 60 below the second edge 62 of the second extension strip 60. In one embodiment, a portion of the first extension strip 50 between the first lateral interlocking member 80 and the first edge 51 of the first extension strip 50 is not attached to the first wall 10. In another embodiment, a portion 55 of the first extension strip 50 between the first lateral interlocking member 80 and the second edge can be heat-sealed to the first wall 10, and a portion of the first extension strip 50 between the first lateral interlocking member 80 and the heat-sealed portion 55 is not coupled to the first wall 10. Similarly, a portion 65 of the second extension strip 60 between the second lateral interlocking member 90 and the first edge 61 of the second extension strip 60 can be heat-sealed to the second wall 20, and a portion of the second extension strip 60 between the second lateral interlocking member 90 and the heat-sealed portion 65 is not attached to the second wall 20.

When referring to an "edge", the "edge" is referred to as an "edge" because it is attached to a wall to define an attachment edge for an extension strip. For example, the first edge 51 of the first extension strip 50 is attached to the first wall 10 to define an attachment edge for the first extension strip 50. However, it should be understood that the first extension strip 50 and the second extension strip 60 can include material that extends below this attachment edge 51, as illustrated by portion 56.

With particular reference again to the detailed cross-sectional side view of the resealable container 100 in FIG. 2B, the closure strip assembly 70 can comprise the first lateral interlocking member 80 and the second lateral interlocking member 90. In one embodiment, the first lateral interlocking member 80 can comprise at least two asymmetrical female strips or channels 81, and the second lateral interlocking member 90 can comprise at least two asymmetrical male strips or beads 91 that correspond to the at least two asymmetrical female strips or channels 81. Each of the at least two asymmetrical female channels 81 can comprise a first J-shaped member 84, and each of the at least two asymmetrical male beads 91 can comprise a second J-shaped member 94. The first J-shaped member 84 and the second J-shaped member 94 can face opposite directions. For example, as illustrated in FIG. 2B, the first J-shaped member 84 can face the bottom edge 33 of the first wall 10, and the second J-shaped member 94 can face the top edge 37 of the second wall 20.

The first J-shaped member 84 can engage the second J-shaped member 94 when the first lateral interlocking member 80 is operatively connected to the second lateral interlocking member 90 in a sealed configuration. When the first lateral interlocking member 80 and the second lateral interlocking member 90 are engaged, the first J-shaped member 84 and the second J-shaped member 94 cannot be disengaged without going through a proper disengagement process. Accordingly, the closure strip assembly 70 can provide child-resistance for the resealable container 100.

The first and second lateral interlocking members 80, 90 can be operable to disengage each other when the female interlocking strip 81 is caused to rotate relative to the male interlocking strip 91 so that the first J-shaped member 84 disengages from the second J-shaped member 94 in an opened configuration. For example, the first and second lateral interlocking members 80, 90 can be operable to disengage each other when the female interlocking strip 81 is caused to rotate relative to the male interlocking strip 91 such that a free end 85 of the first J-shaped member 84 rotates toward the top edge 36 of the first wall 10 (e.g., counter-clockwise in FIG. 2B) and a free end 95 of the second J-shaped member 94 rotates toward the bottom edge 33 of the second wall 20 (e.g., counter-clockwise in FIG. 2B).

Figure 4:
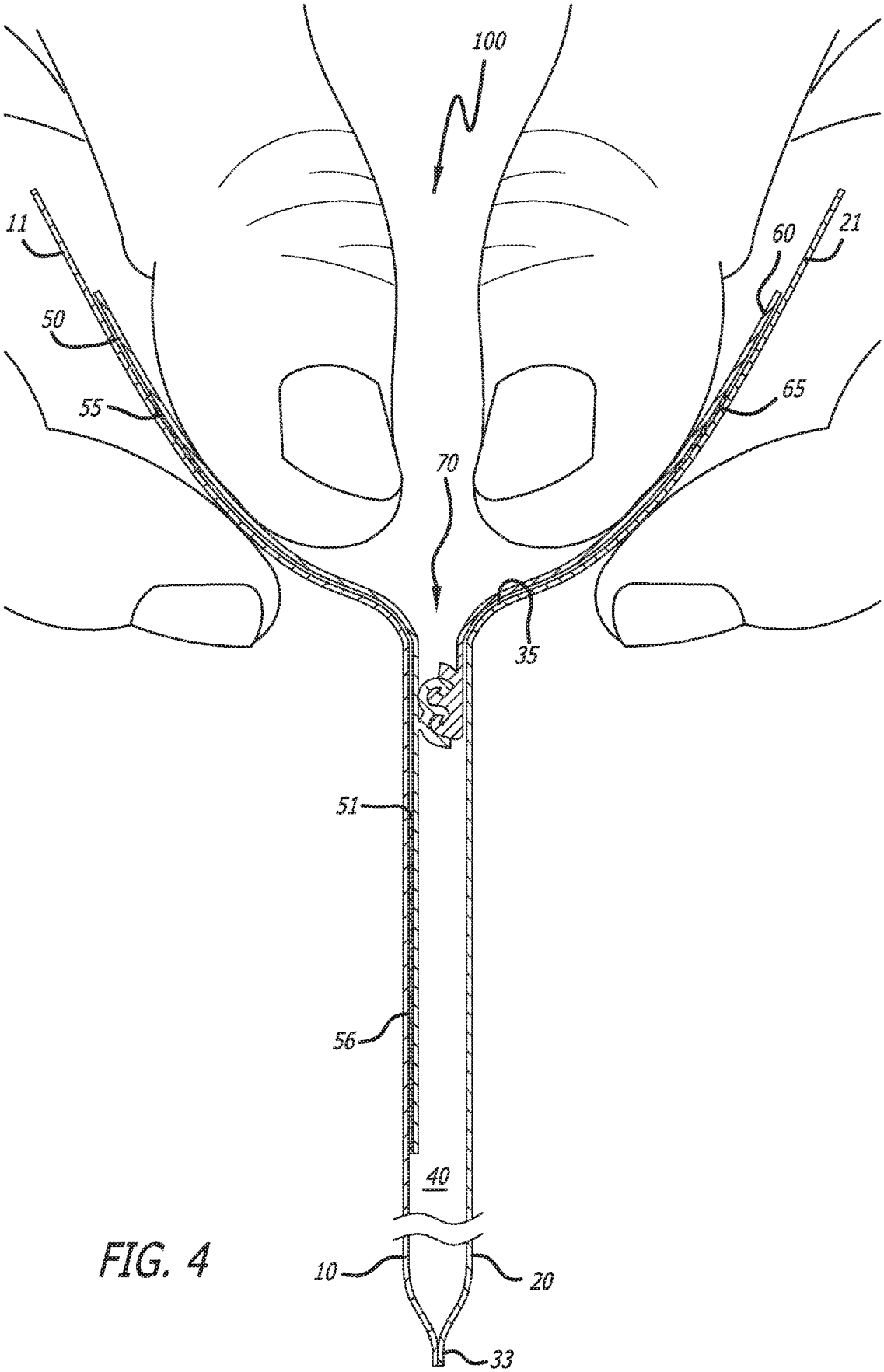
FIG. 4 is a cross-sectional side view of the resealable container of FIG. 1 shown grasped by a user for opening.
Figure 5:
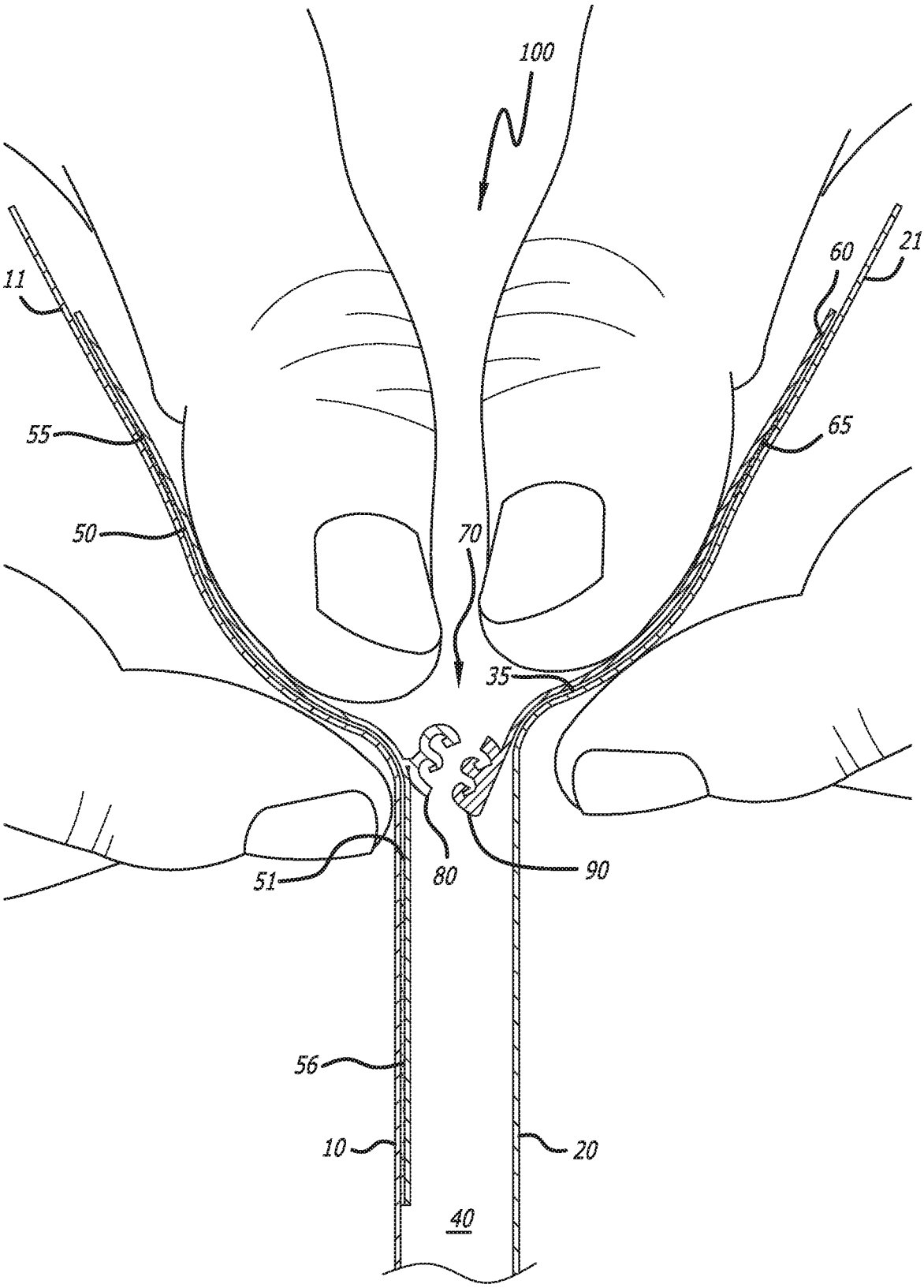
FIG. 5 is a cross-sectional side view of the resealable container of FIG. 1 showing the closure strip assembly in an opened configuration following a correct opening attempt.

With particular reference to the cross-sectional side views of the resealable container 100 in FIGS. 4 and 5, the first and second lateral interlocking members 80, 90 described above are configured to become disengaged (e.g., disconnected) from each other when the first flap 11 and the second flap 21 are pulled apart from each other as the second extension strip 60 is held against the interior surface 35 of the second wall 20. When the second extension strip 60 is held down in this way, as the first and second flaps 11, 21 are pulled apart, the first and second lateral interlocking member 80, 90 are permitted to rotate relative to each other such that they can become disengaged. In one embodiment, the first extension strip 50 should be held against the interior surface 34 of the first wall 10 as well during the pulling apart to disengage the first and second lateral interlocking members 80, 90. A person may hold either or both the first extension strip 50 against the interior surface 34 of the first wall and the second extension strip 60 against the interior surface 35 of the second wall 20 at a location close to the first and second lateral interlocking members 80, 90 to effectuate the rotational movement of the members 80, 90. In this way, a relative rotation between the first and second lateral interlocking members 80, 90 can be maximized.

In contrast, with particular reference to the cross-sectional side view of the resealable container 100 in FIG. 6, the first and second lateral interlocking members 80, 90 described above are configured to remain operatively connected when the first flap 11 and the second flap 21 are pulled apart without also holding at least the second extension strip 60 against the interior surface 35 of the second wall. 20. When the first and second flaps 11, 21 are pulled in this way, the second extension strip 60 is allowed to be pulled away from the second wall 20, thus minimizing the relative rotation between the first and second lateral interlocking members 80, 90. As illustrated, a person may not be able to provide the relative rotation needed to disengage the first and second lateral interlocking members 80, 90.

It should be appreciated from the foregoing description that the present invention provides an improved child-resistant closure system.

Specific methods, devices, and materials are described, although any methods and materials similar or equivalent to those described can be used in the practice or testing of the present embodiment. Unless defined otherwise, all technical and scientific terms used herein have the same meanings as commonly understood by one of ordinary skill in the art to which this embodiment belongs. The terms "a," "an," and "at least one" encompass one or more of the specified element. That is, if two of a particular element are present, one of these elements is also present and thus "an" element is present. The terms "a plurality of" and "plural" mean two or more of the specified element. The term "or" used between the last two of a list of elements means any one or more of the listed elements. For example, the phrase "A, B, or C" means "A, B, and/or C," which means "A," "B," "C," "A and B," "A and C," "B and C," or "A, B, and C." The term "coupled" generally means physically coupled or linked and does not exclude the presence of intermediate elements between the coupled items absent specific contrary language. The term "vertical" refers to a direction from the top of the bag to the bottom of the bag, where the top is considered the location of the opening. The terms "lateral" and "horizontal" refer to the direction from side to side, which is generally orthogonal to the vertical direction. The terms "lower" and "below" refer to a direction toward the bottom of the bag and the terms "higher" and "above" refer to a direction toward the top of the bag.

Without further elaboration, it is believed that one skilled in the art, using the proceeding description, can make and use the present invention to the fullest extent. The invention has been described in detail with reference only to the presently preferred embodiments. Persons skilled in the art will appreciate that various modifications can be made without departing from the invention. Accordingly, the invention is defined only by the following claims.

The invention claimed is:

1. A resealable container comprising:

a first wall and a second wall, the first and second walls sealed together along respective side edges and bottom edges of the first and second walls such that interior surfaces of the first and second walls form a storage space therebetween, wherein a top edge of the first wall and a top edge of the second wall define an opening for the storage space;

a first extension strip having a bottom attachment portion and a top attachment portion, wherein:

the first extension strip is attached to the interior surface of the first wall at the bottom attachment portion of the first extension strip and at the top attachment portion of the first extension strip, the first extension strip is unattached to the interior surface of the first wall between the bottom attachment portion of the first extension strip and the top attachment portion of the first extension strip, and a portion of the first wall extends upwardly from adjacent the bottom attachment portion of the first extension strip to the top edge of the first wall to define a first flap;

a second extension strip having a top attachment portion and a bottom edge, wherein:

the top attachment portion of the second extension strip is attached to the interior surface of the second wall below the top edge of the second wall, the second extension strip is unattached to the interior surface of the second wall beneath the top attachment portion of the second extension strip such that the bottom edge of the second extension strip is unattached to the interior surface of the second wall, and a portion of the second wall extends upwardly from adjacent the bottom edge of the second extension strip to the top edge of the second wall to define a second flap; and a closure strip assembly comprising a first lateral interlocking member, wherein the first lateral interlocking member comprises a lower attached-portion and an upper free-portion opposite the lower attached-portion, wherein the lower attached-portion is attached to the first extension strip between the bottom attachment portion and the top attachment portion of the first extension strip, and wherein the upper free-portion is not attached to the first extension strip or to the interior surface of the first wall— has been inserted, in order clearly set forth the structure of the closure strip assembly to accomplish the function of remaining operatively connected when the first flap and the second flap are pulled apart without holding, against the interior surface of the second wall, a portion of the second extension strip located between the second lateral interlocking member and the top attachment portion of the second extension strip, and a second lateral interlocking member operatively connectable to the first interlocking member;

wherein the first lateral interlocking member is attached to the first extension strip at a portion of the first extension strip that extends between the bottom and top attachment portions of the first extension strip;

wherein the second lateral interlocking member is attached at the bottom edge of the second extension strip; and wherein the first and second lateral interlocking members are configured to remain operatively connected when the first flap and the second flap are pulled apart without holding, against the interior surface of the second wall, a portion of the second extension strip located between the second lateral interlocking member and the top attachment portion of the second extension strip.

2. The resealable container of claim 1, wherein when the first flap and the second flap are pulled apart without holding the portion of the second extension strip located between the second lateral interlocking member and the top attachment portion of second extension strip against the interior surface of the second wall, a relative rotation between the first and second lateral interlocking members is decreased.

3. The resealable container of claim 1, wherein the first and second lateral interlocking members are configured to become disengaged from each other when the first flap and the second flap are pulled apart from each other as the portion of the second extension strip located between the second lateral interlocking member and the top attachment portion of second extension strip is held against the interior surface of the second wall.

4. The resealable container of claim 3, wherein relative rotation between the first lateral interlocking member and the second lateral interlocking member increases when the portion of the second extension strip held against the interior surface of the second wall has an increasing proximity to the second interlocking member.

5. The resealable container of claim 3, wherein the first and second lateral interlocking members are configured to become disengaged from each other when the first flap and the second flap are pulled apart from each other as a portion of the first extension strip located between the first interlocking member and the top attachment portion of the first extension strip is additionally held against the interior surface of the first wall.

6. The resealable container of claim 5, wherein when the first flap and the second flap are pulled apart from each other as the portion of the first extension strip located between the first interlocking member and the top attachment portion of the first extension strip is additionally held against the interior surface of the first wall and the portion of the second extension strip located between the second lateral interlocking member and the top attachment portion of second extension strip is held against the interior surface of the second wall, the relative rotation between the first and second lateral interlocking members is increased.

7. The resealable container of claim 6, wherein relative rotation between the first lateral interlocking member and the second lateral interlocking member increases when the portion of the first extension strip held against the interior surface of the first wall has an increasing proximity to the first interlocking member.

8. The resealable container of claim 1, wherein the first lateral interlocking member comprises at least two asymmetrical female strips, and wherein the second lateral interlocking member comprises at least two asymmetrical male strips.

9. The resealable container of claim 1, wherein the first lateral interlocking member comprises at least two female interlocking channels, and wherein the second lateral interlocking member comprises at least two male interlocking beads.

10. The resealable container of claim 9, wherein each of the at least two female interlocking channels comprises a first J-shaped member, and wherein each of the at least two male interlocking beads comprises a second J-shaped member.

11. The resealable container of claim 10, wherein the first J-shaped member faces the bottom edge of the first wall, and wherein the second J-shaped member faces the top edge of the second wall.

12. The resealable container of claim 10, wherein the first J-shaped member engages the second J-shaped member when the first lateral interlocking member is operatively connected to the second lateral interlocking member.

13. The resealable container of claim 10, wherein the first and second lateral interlocking members are operable to disengage each other when the female interlocking strip is rotated relative to the male interlocking strip so that the first J-shaped member disengages from the second J-shaped member.

14. The resealable container of claim 10, wherein the first and second lateral interlocking members are operable to disengage each other when the female interlocking strip is rotated relative to the male interlocking strip so that a free end of the first J-shaped member rotates toward the top edge of the first wall and a free end of the second J-shaped member rotates toward the bottom edge of the second wall.

15. The resealable container of claim 1, wherein each of the first wall and the second wall is a unitary sheet.

16. The resealable container of claim 1, wherein the second lateral interlocking member comprises an upper attached-portion and a lower free-portion opposite the upper attached-portion, wherein the upper attached-portion is attached to the bottom edge of the second extension strip, and wherein the lower free-portion is not attached to the second extension strip or to the interior surface of the second wall.

17. The resealable container of claim 1, wherein the second extension strip extends between the second lateral interlocking member and the top edge of the second wall.

* * * * *